US006952862B2

(12) United States Patent
Axelsson

(10) Patent No.: US 6,952,862 B2
(45) Date of Patent: Oct. 11, 2005

(54) TOOL HANDLE EXTENSION CONNECTOR

(75) Inventor: Jan Axelsson, Bankeryd (SE)

(73) Assignee: Anza AB, Bankeryd (SE)

( * ) Notice: Subject to any disclaimer, the term of this patent is extended or adjusted under 35 U.S.C. 154(b) by 0 days.

(21) Appl. No.: 10/169,881

(22) PCT Filed: Jan. 9, 2001

(86) PCT No.: PCT/SE01/00024

§ 371 (c)(1),
(2), (4) Date: Oct. 8, 2002

(87) PCT Pub. No.: WO01/51257

PCT Pub. Date: Jul. 19, 2001

(65) Prior Publication Data

US 2003/0103803 A1 Jun. 5, 2003

(30) Foreign Application Priority Data

Jan. 13, 2000 (DK) ..... 2000 00013 U

(51) Int. Cl.[7] ..... A45C 13/22
(52) U.S. Cl. ..... 16/422; 16/426
(58) Field of Search ..... 16/422, 426, 427, 16/110.1; 403/109.1, 109.2, 109.3, 109.4, 322.1, 322.3, 322.4, 325, 326, 329

(56) References Cited

U.S. PATENT DOCUMENTS 2,501,940 A 3/1950 Hibbard
4,247,216 A 1/1981 Pansini
4,911,034 A * 3/1990 Kulczyk et al. ..... 403/377
5,168,693 A * 12/1992 Ingvardsen ..... 403/289
5,375,938 A 12/1994 Bartlow
5,590,974 A * 1/1997 Yang ..... 403/327
5,779,386 A * 7/1998 Eichhorn ..... 403/329
6,117,664 A 9/2000 Schulein et al.
6,292,979 B1 * 9/2001 Kuo ..... 16/113.1
6,315,488 B1 * 11/2001 Parker ..... 403/329

FOREIGN PATENT DOCUMENTS

| | | |
|---|---|---|
| DK | 9500108 | 6/1996 |
| SE | 50417869 | 10/1997 |
| SE | 90062989 | 8/2000 |
| WO | WO9949755 | 10/1999 |

* cited by examiner

*Primary Examiner*—John R. Cottingham
(74) *Attorney, Agent, or Firm*—Ladas & Parry LLP

(57) ABSTRACT

A connector for connecting an extension handle with the handle of a tool. The connector includes a locking mechanism in the form of at least one shoulder on the connector engaging a hole in the tool handle. The shoulder (1) is connected to a knob via a tongue which is integral with the connector and the knob is placed such that it is located outside the tool handle. The front part of the connector may be split into two halves by a slit. The connector hold the tool firmly. Also, it is easy to disconnect the tool from the connector.

16 Claims, 2 Drawing Sheets

TOOL HANDLE EXTENSION CONNECTOR

FIELD OF USE OF THE PRODUCT

It is often desired to use an extension handle of painting tools in order to paint the ceiling and the floor and other places hard to reach more comfortably. The extension handle is connected to the tool by means of a connector, which is to hold the tool firmly during the painting work. Also, it should be easy to disconnect the tool from the connector. The tool may be e.g. a painter's roll or brush.

STATE OF THE ART

Connectors for extension handles are previously known as such. Often they have shoulders engaging holes of the tool handle. When the tool is to be disconnected from the connector one has to press on the shoulder and depress it into the hole so that the tool may be pulled off. This may be difficult to perform as the holes are relatively small and one often works with gloves on the hands. The edge around the hole interferes with the inward movement of the fingers.

In the present invention the shoulder is located on a tongue together with a knob located outside the tool. The tool is disconnected from the connector by pressing on the knob. There is no hole edge round the knob and the knob may be suitably designed so that it is easy to depress.

THE DRAWINGS

DETAILED DESCRIPTION

In the figures there is shown the product according to the invention being used to connect a painting tool in the front end and an extension handle in the rear end. The tool and the handle are not shown. The connector is manufactured from a suitable plastic material being sufficiently rigid but also resilient in certain parts.

Figure 1:
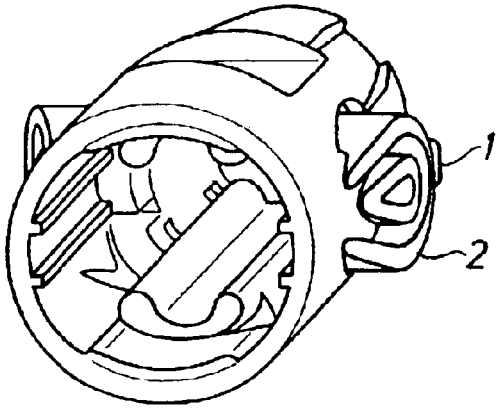
FIG. 1 shows the product according to the invention as viewed obliquely from behind, i.e. the attachment towards the extension handle.

In FIG. 1 the rear part of the connector is shown in which an extension handle is to be inserted and held. The inside of the connector is provided with tongues and guide grooves, which do not form part of the invention as such.

Figure 2:
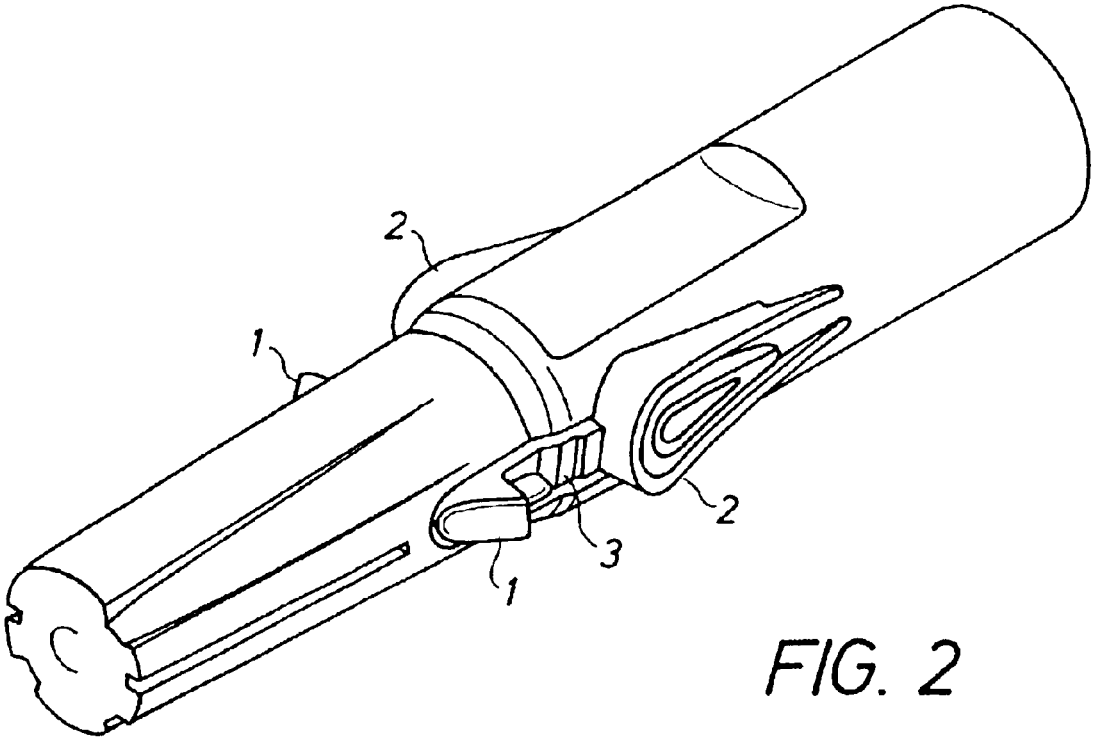
FIG. 2 shows the connector obliquely from the front where the connector is to be attached to the tool.

In FIG. 2 the connector is shown from the front. A painting tool with a hollow handle is pushed on and guided by guide ribs. When the tool reaches a pair of shoulder 1, these are depressed under the edge of the tool handle and caught in recesses or holes in the handle.

The shoulders 1 have a ramp on one side and a face normal to the connector at the other side. Thus, to disconnect the tool the shoulders 1 have to be depressed. This is done by means of a knob 2, which is connected to the shoulder via a resilient tongue 3. The tongue merges with the connector at the edge behind the knob 2. The whole connector with the knobs and shoulders is formed in one piece.

Since the knob is not limited by any hole edge, it may be designed in an ergonomic way. As may be seen in the figure, the knob 2 has a ramp-shaped and drop-shaped design. It is the highest and widest in the front edge and tapers both in width and thickness at the rear edge where the knob merges with the connector.

For best function, the connector is suitably provided with a pair of shoulders 1 and knobs 2 arranged opposite each other at both sides of the connector. Thus, a more steady holding of the tool is achieved and the knobs 2 may be pressed against each other by pressing on them simultaneously.

Figure 3:
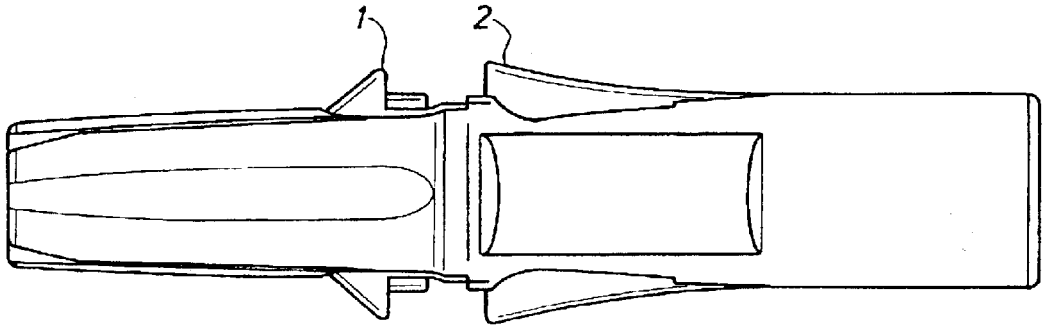
FIG. 3 shows a split embodiment of the connector in a side view.
Figure 4:
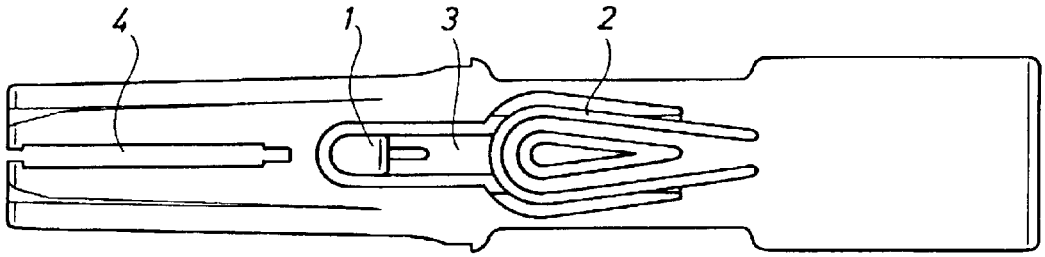
FIG. 4 shows the split connector as viewed from the other side with the split visible.

A further embodiment of the invention is shown in FIGS. 3 and 4. Just as in the first embodiment, the product is provided with shoulders 1, and knobs 2 connected by a tongue 3. In addition the front part is split in two halves by a slit 4 extending from the front almost all the way to the cutaway for the shoulder 1. The width of the slit may e.g. be approximately 15% of the diameter of the connector. The slit 4 enables the two halves to be pressed against each other since the product is made of an elastic material. The slit also makes the connector more easy to connect to the tool and also more tolerant to deviations in dimensions, both in the connector itself and the tool.

What is claimed is:

1. A combined connector and tool handle for connecting to an extension handle, the connector and tool handle comprising:

a tool handle engagement portion;

a connector front part shaped and configured to releasingly engage said tool handle engagement portion;

a connector rear part;

a connector body disposed between said front part and said rear part; and at least one shoulder disposed in said front part and connected to at least one knob disposed in said body, said shoulder being shaped and configured to engage a hole in said tool handle;

said shoulder and said knob being connected by a tongue integrally formed with the connector;

said connector being formed as a unitary, one-place structure, separable from said tool handle.

2. A connector and tool handle according to claim 1, wherein said at least one knob is configured as a ramp, being widest and highest at a front edge and tapering toward an end where the tongue merges with the body of the connector.

3. A connector and tool handle according to claim 1, wherein the connector comprises two shoulders arranged and configured with two associated knobs.

4. A connector and tool handle according to claim 3, wherein said knobs are arranged opposite each other.

5. A connector and tool handle according to claim 1, wherein said front part of the connector is split into two halves by a slit extending from the front part almost all the way to a cutaway of the shoulder.

6. A connector and tool handle according to claim 5, wherein the width of the slit is approximately 15% of the diameter of the connector.

7. A connector and tool handle according to claim 1, wherein said rear part forms said extension handle.

8. A connector and tool handle according to claim 1, wherein said rear part is shaped and configured to engage said extension handle.

9. A connector for connecting an extension handle with a tool handle, the connector comprising:

a front part shaped and configured to releasingly engage said tool handle;

a rear part;

a body disposed between said front part and said rear part; and at least one shoulder disposed in said front part and connected to at least one knob disposed on said body, said shoulder being shaped and configured to engage a hole in said tool handle;

said shoulder and said knob being connected by a tongue integrally formed with the connector;

said connector being formed as a unitary, one-piece structure, separable from said tool handle;

wherein said knob extends transversely outward from said body, and said shoulder extends transversely outward from said shoulder;

wherein an inward depressing of said knob translates an inward depressing of said shoulder.

10. A connector according to claim 9, wherein said at least one knob is configured as a ramp, being widest and highest at a front edge and tapering toward an and where the tongue merges with the body of the connector.

11. A connector according to claim 9, wherein the connector comprises two shoulders arranged and configured with two associated knobs.

12. A connector according to claim 11, wherein said knobs are arranged opposite each other.

13. A connector according to claim 9, wherein said front part of the connector is split into two halves by a slit extending from the front part almost all the way to a cutaway of the shoulder.

14. A connector according to claim 13, wherein the width of the slit is approximately 15% of the diameter of the connector.

15. A connector according to claim 9, wherein said rear part forms said extension handle.

16. A connector according to claim 9, wherein said rear part is shaped and configured to engage said extension handle.

* * * * *

UNITED STATES PATENT AND TRADEMARK OFFICE

CERTIFICATE OF CORRECTION

PATENT NO. : 6,952,862 B2
DATED : October 11, 2005
INVENTOR(S) : Jan Axelsson

It is certified that error appears in the above-identified patent and that said Letters Patent is hereby corrected as shown below:

Column 3,
Line 13, "from said shoulder" should read -- from said body --.

Signed and Sealed this

Seventh Day of March, 2006

JON W. DUDAS
*Director of the United States Patent and Trademark Office*